US009515413B2

(12) United States Patent
Kataoka

(10) Patent No.: US 9,515,413 B2
(45) Date of Patent: Dec. 6, 2016

(54) CONNECTOR WITH RUBBER PLUG HAVING INSERTION HOLE TO RECEIVE PART OF MATING HOUSING THAT DEFORMS PLUG TOWARD WIRE

(71) Applicant: Sumitomo Wiring Systems, Ltd., Yokkaichi, Mie (JP)

(72) Inventor: Shigeto Kataoka, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 14/823,019

(22) Filed: Aug. 11, 2015

(65) Prior Publication Data

US 2016/0064851 A1 Mar. 3, 2016

(30) Foreign Application Priority Data

Sep. 1, 2014 (JP) ..... 2014-177058

(51) Int. Cl.
*H01R 13/40* (2006.01)
*H01R 13/52* (2006.01)

(52) U.S. Cl.
CPC ..... *H01R 13/5202* (2013.01); *H01R 13/5205* (2013.01); *H01R 13/5208* (2013.01); *H01R 13/521* (2013.01); *H01R 13/5219* (2013.01); *H01R 13/5221* (2013.01)

(58) Field of Classification Search
CPC ..... H01R 13/5208; H01R 13/5205; H01R 13/5221; H01R 13/521; H01R 13/5219
USPC ..... 439/587, 271
See application file for complete search history.

(56) References Cited

U.S. PATENT DOCUMENTS 4,784,617 A * 11/1988 Oda ..... H01R 13/4364 439/595
6,102,740 A * 8/2000 Murakami ..... H01R 13/5205 439/271
6,186,829 B1 * 2/2001 Murakami ..... H01R 13/5205 439/274
6,190,203 B1 * 2/2001 Murakami ..... H01R 13/5219 439/274
6,231,388 B1 * 5/2001 Murakami ..... H01R 13/5208 439/273
6,341,984 B1 * 1/2002 Murakami ..... H01R 13/5208 439/587
6,354,852 B2 * 3/2002 Noro ..... H01R 13/62938 439/157

(Continued)

*Primary Examiner* — Abdullah Riyami
*Assistant Examiner* — Vladimir Imas
(74) *Attorney, Agent, or Firm* — Gerald E. Hespos; Michael J. Porco; Matthew T. Hespos

(57) ABSTRACT

A connector is provided with a first housing including a plurality of cavities and a passage hole, a rubber plug having a plurality of sealing holes through which wires are insertable in a liquid tight manner is mounted in the first housing. A second housing is connected to the first housing and includes a wrench preventing portion configured to regulate the connection of the second housing in an inclined posture to the first housing by being inserted into the passage hole at the time of the connection. The rubber plug includes an insertion hole which is expanded by the insertion of a tip part of the wrench preventing portion inserted through the passage hole at the time of the connection and applies a compression force to the sealing holes in a direction to be in closer contact with the wires when being expanded.

9 Claims, 6 Drawing Sheets

(56) References Cited

U.S. PATENT DOCUMENTS 6,361,341 B1 * 3/2002 Okayasu ..... H01R 13/5216 439/271
6,375,500 B1 * 4/2002 Murakami ..... H01R 13/5205 439/196
6,558,179 B2 * 5/2003 Nakamura ..... H01R 13/5221 439/275
6,638,108 B2 * 10/2003 Tachi ..... H01R 13/4223 439/540.1
6,910,905 B2 * 6/2005 Tanaka ..... H01R 13/5208 439/271
7,033,216 B2 * 4/2006 Ito ..... H01R 13/5208 439/275
7,156,698 B2 * 1/2007 Yamashita ..... H01R 13/5208 439/587
7,201,609 B2 * 4/2007 Ishikawa ..... H01R 13/5219 439/157
7,419,395 B2 * 9/2008 Tsuji ..... H01R 13/5221 439/271
7,448,894 B2 * 11/2008 Tsuji ..... H01R 13/4364 439/271
7,503,791 B2 * 3/2009 Fukaya ..... H01R 13/5208 439/275
7,572,150 B2 * 8/2009 Matsuoka ..... H01R 13/207 439/626
7,922,530 B2 * 4/2011 Chazottes ..... H01R 13/5208 439/587
8,215,987 B2 * 7/2012 Yoshioka ..... H01R 13/4362 439/587
8,469,742 B2 * 6/2013 Shiga ..... H01R 13/5208 439/587
8,608,508 B2 * 12/2013 Kataoka ..... H01R 13/5208 439/275
8,622,769 B2 * 1/2014 Mizutani ..... H01R 13/113 439/595
8,662,921 B2 * 3/2014 Kataoka ..... H01R 13/443 439/148
9,106,000 B2 * 8/2015 Mizutani ..... H01R 13/4365
9,178,301 B2 * 11/2015 Shiga ..... H01R 13/5205
2014/0051276 A1 2/2014 Itou

* cited by examiner

CONNECTOR WITH RUBBER PLUG HAVING INSERTION HOLE TO RECEIVE PART OF MATING HOUSING THAT DEFORMS PLUG TOWARD WIRE

BACKGROUND

1. Field of the Invention

The present invention relates to a connector.

2. Description of the Related Art

A connector disclosed in U.S. Patent Application Publication No. US 2014/0051276 is provided with a first housing including first cavities into which terminal fittings connected to end parts of wires are insertable, and a rubber plug to be mounted in the first housing including a plurality of wire insertion holes, at positions communicating with the cavities, into which the wires are insertable in a liquid-tight manner after the passage of the terminal fittings. A second housing is connectable to the first housing. The first housing is composed of an inner housing including the cavities and an outer housing, and the rubber plug is accommodated in a state sandwiched between a rear surface of the inner housing and a front surface of the outer housing.

There is a possibility that an edge part of the terminal fitting contacts and damages the rubber plug when the terminal fitting passes through the wire insertion hole of the rubber plug. To avoid damage to the rubber plug, a diameter of the wire insertion hole is required to be large. However, if the diameter of the wire insertion hole is increased, the wire insertion hole may not be in close contact with the wire inserted therein and waterproofness may be reduced. Thus, strict dimensional management is necessary for the diameter of the wire insertion hole.

The present invention was completed based on the above situation and aims to provide a connector capable of satisfactorily ensuring waterproofness.

SUMMARY

The present invention is directed to a connector with a first housing including a plurality of cavities into which terminal fittings connected to ends of wires are insertable. A passage hole penetrates the first housing in a front-back direction. A rubber plug is mounted in the first housing and includes a plurality of sealing holes at positions communicating with the plurality of cavities. The wires are insertable into the plurality of sealing holes in a liquid-tight manner after the passage of the terminal fittings therethrough. A second housing is connected to the first housing and includes a wrench preventing portion configured to regulate the connection posture of the second housing to the first housing by being inserted into the passage hole at the time of the connection. The rubber plug includes an insertion hole which is expanded by the insertion of a tip part of the wrench preventing portion inserted through the passage hole at the time of the connection and applies a compression force on the plurality of sealing holes to compress the sealing holes into close contact with the wires at a position communicating with the passage hole.

In a state before the first housing is connected to the second housing, the tip part of the wrench preventing portion is not inserted in the insertion hole of the rubber plug and no compression force is applied to the sealing holes. Thus, sliding resistance between the terminal fittings passing through the sealing holes and the rubber plug can be reduced by setting a relatively large diameter for the sealing holes. Therefore, a situation of damaging the rubber plug can be avoided.

On the other hand, when the first housing is connected to the second housing, the tip part of the wrench preventing portion is inserted into the insertion hole of the rubber plug to expand the insertion hole. Since the compression force is applied to the sealing holes, the rubber plug and the wires are in closer contact and waterproofness can be satisfactorily ensured.

Particularly, since the wrench preventing portion also has an additional function of ensuring waterproofness by expanding the insertion hole, it is not necessary to separately provide a structure for ensuring waterproofness, the overall structure can be simplified and enlargement can be avoided.

The connector is further provided with a rear holder to be mounted into the first housing and capable of holding the rubber plug while sandwiching the rubber plug between the first housing and the rear holder in a front-back direction, and the tip of the wrench preventing portion is covered with a wall surface of the rear holder at the time of the connection. Thus, the waterproofness of the rubber plug can be ensured even though the insertion hole penetrates through the rubber plug.

A plurality of the sealing holes are arranged to surround the insertion hole in the rubber plug. By such an arrangement, the compression force is substantially equally transmitted to the plurality of sealing holes and waterproofness around the wire inserted in each sealing hole can be stably maintained when the insertion hole is expanded by the wrench preventing portion.

BRIEF DESCRIPTION OF THE DRAWINGS

FIG. 5 is a rear view of the first housing, and.

DETAILED DESCRIPTION

Preferred embodiments of the present invention are described below.

Figure 1:
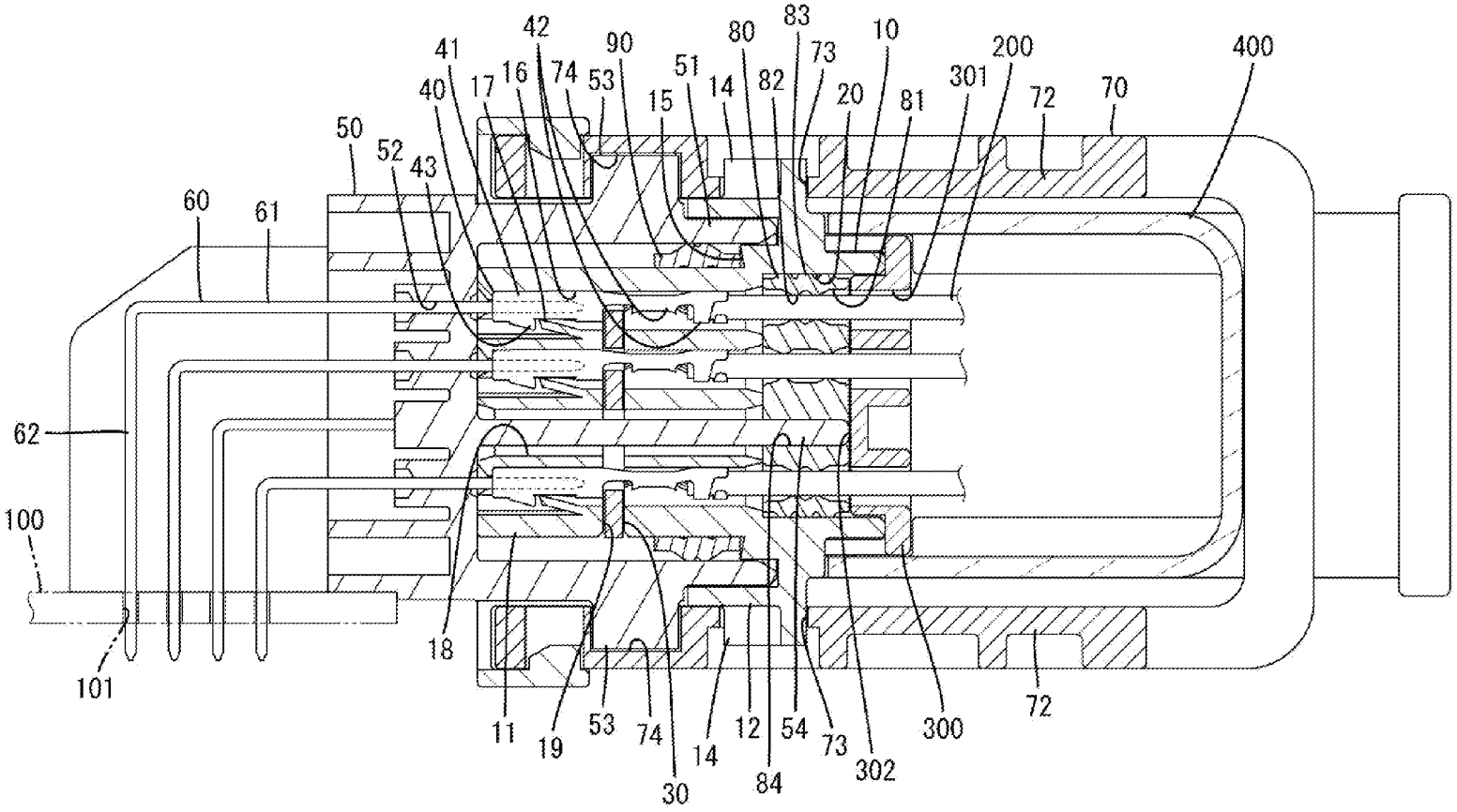
FIG. 1 is a sectional view showing a state where first and second housings are properly connected in a connector according to an embodiment of the present invention.
Figure 2:
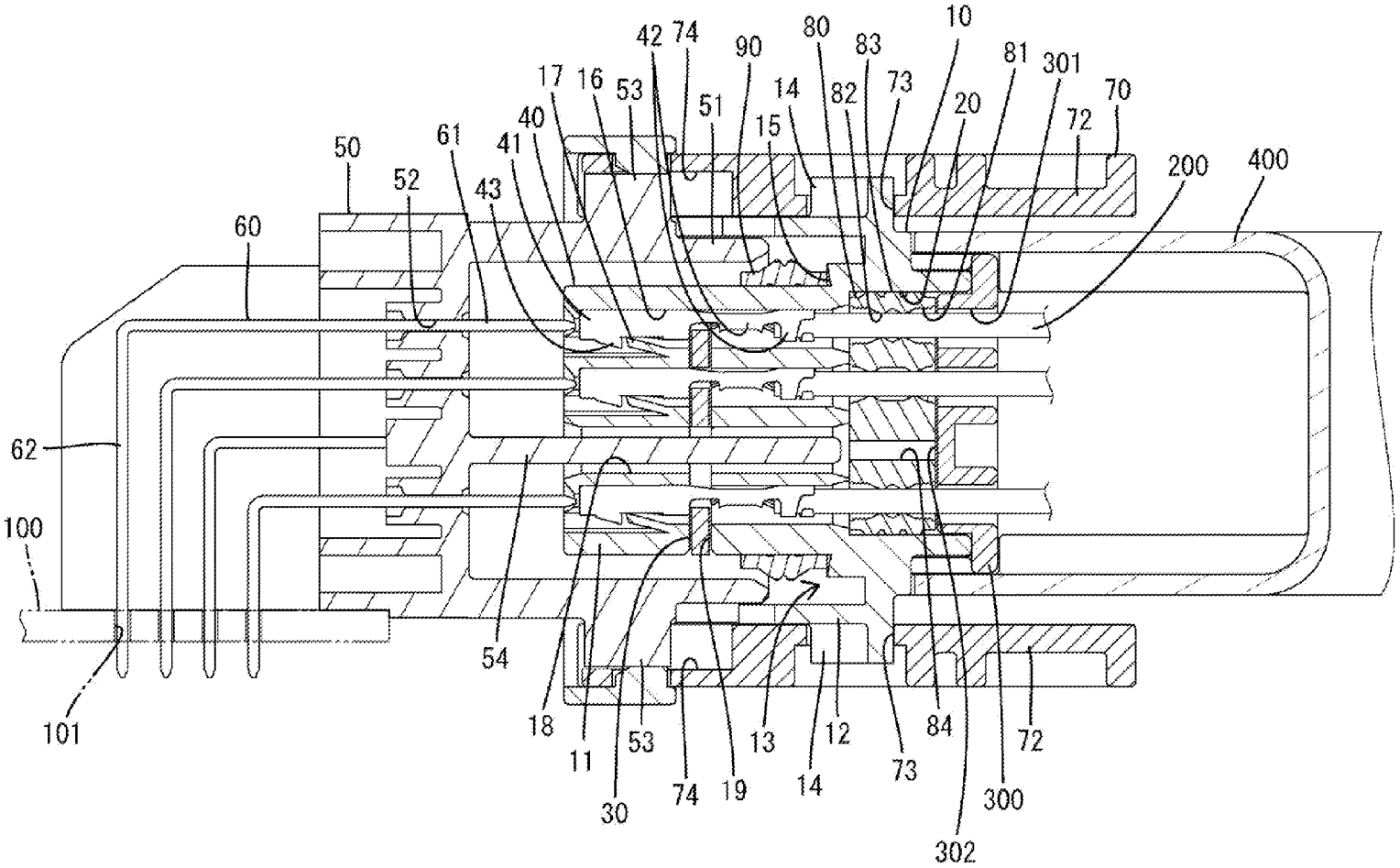
FIG. 2 is a section showing a state while the first and second housings are being connected.

Hereinafter, an embodiment is described with reference to the drawings. As shown in FIGS. 1 and 2, a connector of this embodiment includes a first housing 10 and a second housing 50 connectable to each other, and an integration-type rubber plug 80 to be mounted in the first housing 10. Note that, in the following description, a surface side on which the first and second housings 10, 50 are facing each other at the time of starting a connection is referred to as a front side and a vertical direction is based on each figure. Further, a width direction is a lateral direction in FIGS. 3, 5 and 6.

Figure 3:
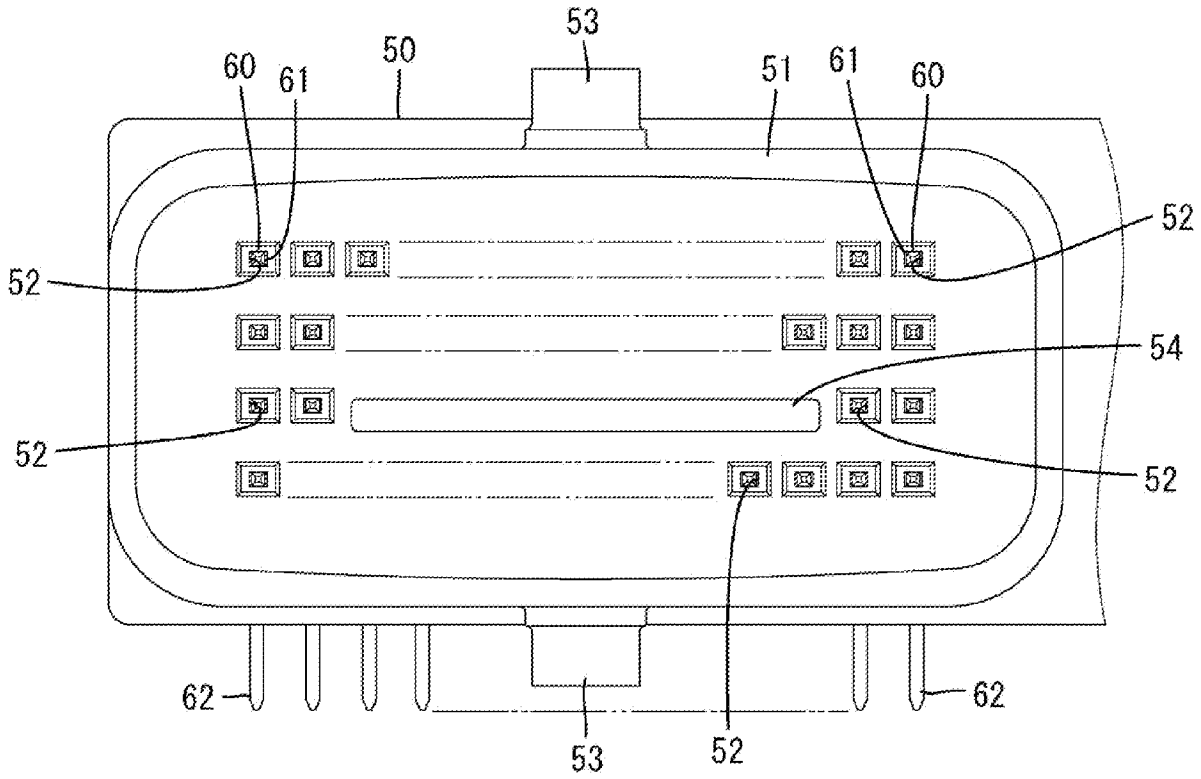
FIG. 3 is a front view of the second housing.
Figure 4:
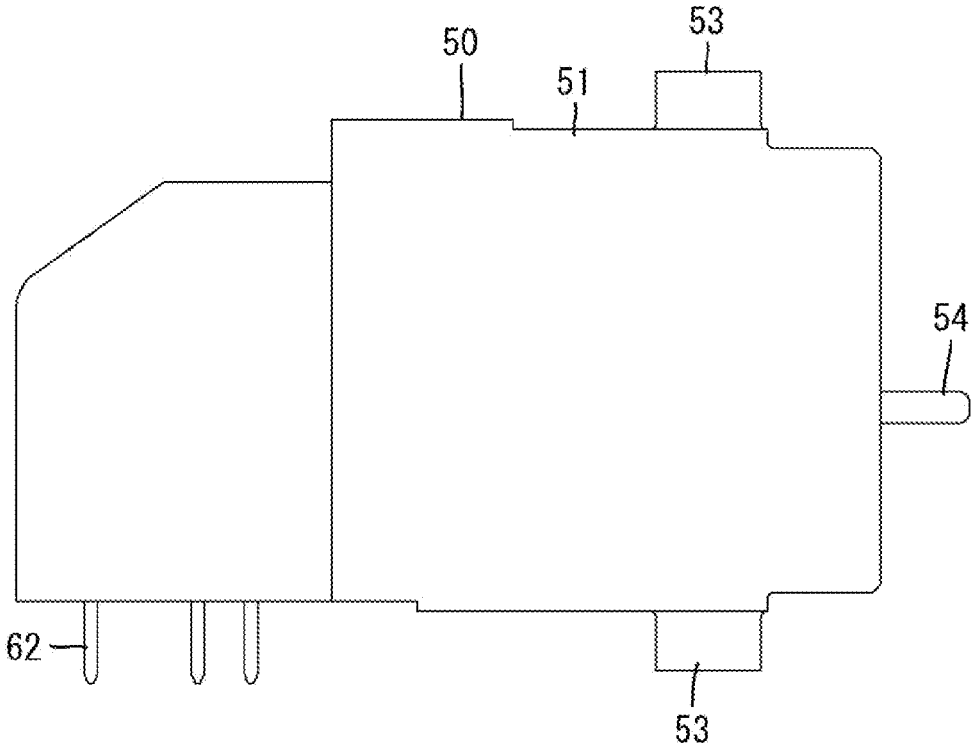
FIG. 4 is a side view of the second housing.
Figure 5:
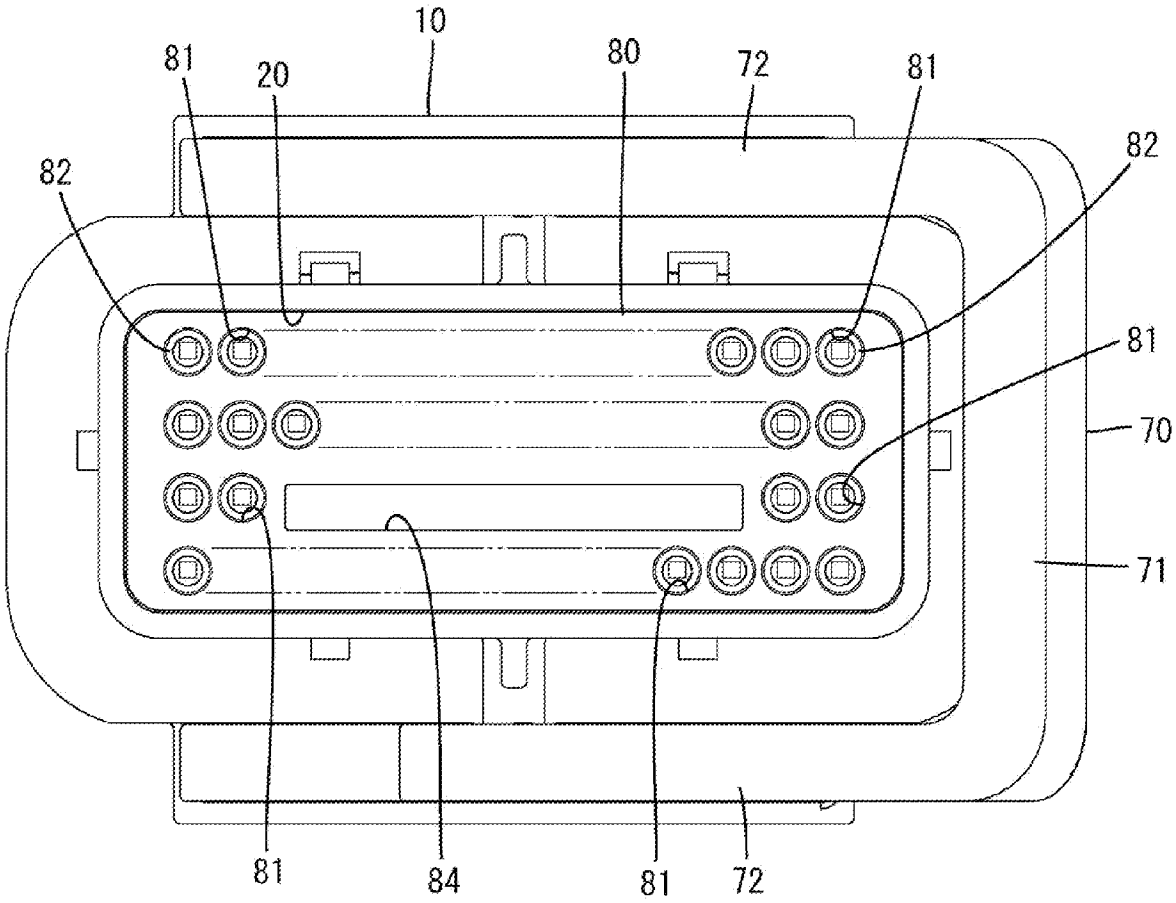

The second housing 50 is made of synthetic resin and includes, as shown in FIGS. 4 and 5, a tubular receptacle 51 projecting forward. Preferably, a pair of tubular receptacles 51 are provided and are connected side-by-side. However, only a single tubular receptacle 51 is shown for the sake of convenience. As shown in FIGS. 1 and 2, a plurality of mounting holes 52, through which pin-like male terminal fittings 60 are mountable, are provided and penetrate through a back wall of the receptacle 51 in a front-back direction. As shown in FIG. 3, a plurality of mounting holes 52 are arranged side by side in the width direction and the vertical direction. As shown in FIG. 1, the male terminal fitting 60 is substantially L-shaped and includes a horizontal portion 61 projecting into the receptacle 51 through the mounting hole 52 and pulled out backward from the receptacle 51, and a vertical portion 62 extending downward from the rear end of the horizontal portion 61. A lower end part of the vertical portion 62 is inserted into a connection hole 101 of a printed circuit board 100 to be electrically connected.

As shown in FIGS. 3 and 4, a pair of substantially cylindrical cam followers 53 project substantially in widthwise central parts of the upper and lower surfaces of a peripheral wall of the receptacle 51. Further, on the front surface of the back wall of the receptacle 51, a wrench preventing portion 54 is provided to project forward at a position slightly displaced downwardly from a vertical center of the receptacle 51. The wrench preventing portion 54 is in the form of a rectangular flat plate and arranged along the width direction. As shown in FIG. 4, a front end part of the wrench preventing portion 54 is arranged to project further forward than the front end of the receptacle 51. As shown in FIG. 3, the mounting holes 52 are dotted around the wrench preventing portion 54 to surround an entire circumference of the wrench preventing portion 54.

Figure 6:
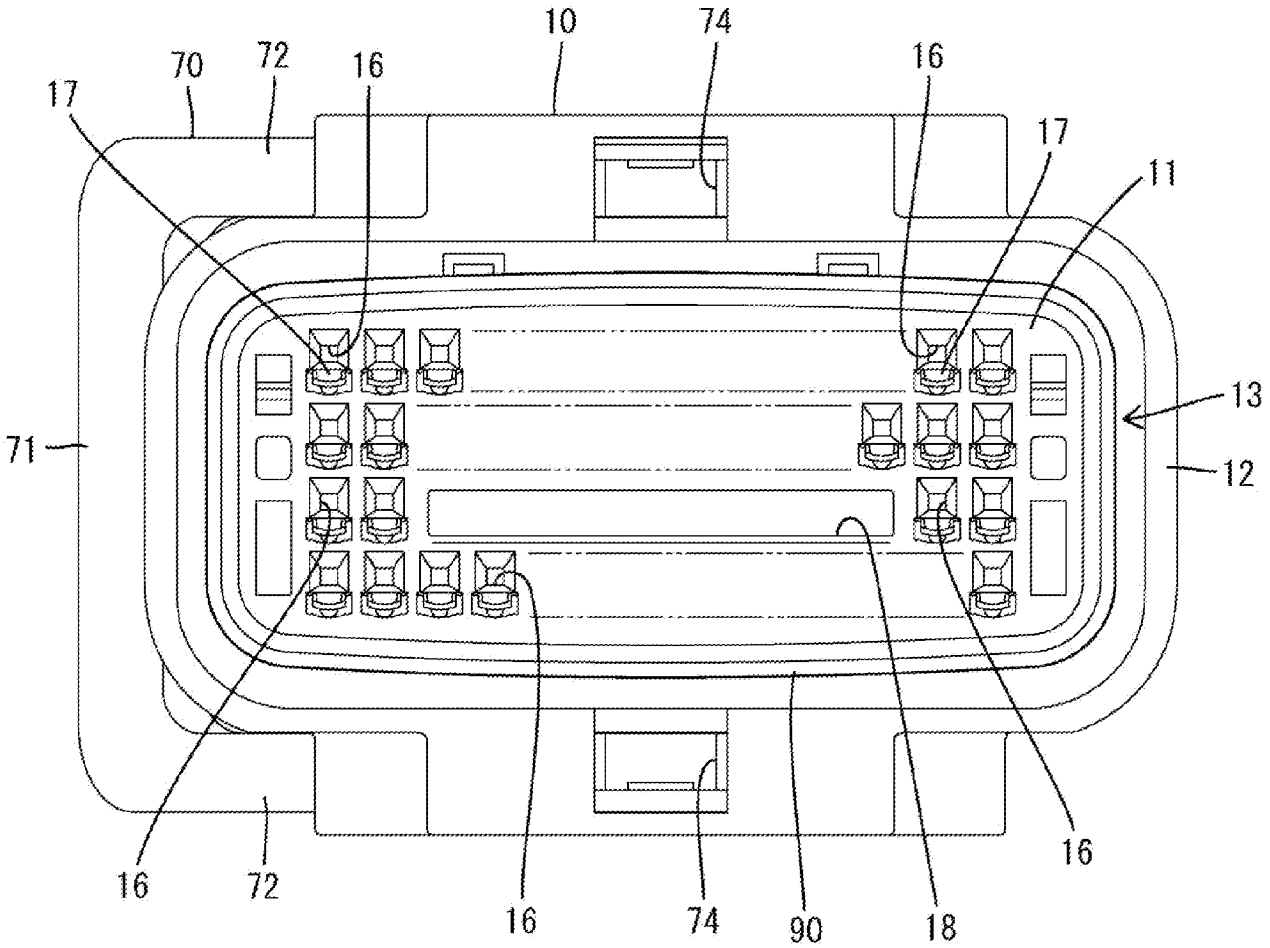
FIG. 6 is a front view of the first housing.

The first housing 10 is made of synthetic resin and includes, as shown in FIG. 6, a block-like housing main body 11 and a tubular fitting tube portion 12 surrounding the housing main body 11. As shown in FIG. 2, a connection space 13 into which the receptacle 51 is inserted when the first and second housings 10, 50 are connected is open forward between the fitting tube portion 12 and the housing main body 11. A pair of substantially cylindrical supporting shafts 14 are provided to project substantially in widthwise central parts of the upper and lower surfaces of the fitting tube portion 12 (see FIGS. 1 and 2). A lever 70 is rotatably mounted on the pair of supporting shafts 14.

The lever 70 is made of synthetic resin and, as shown in FIG. 5, is in the form of a gate-shaped frame and includes an operating portion 71 extending along the vertical direction and a pair of arm portions 72 projecting substantially in parallel to each other from opposite upper and lower ends of the operating portion 71. As shown in FIGS. 1 and 2, the arm portion 72 is provided with a bearing portion 73. The lever 70 is mounted to straddle the first housing 10 from behind and rotatable between an initial position, as shown in FIGS. 1, 5 and 6, and a connection position, as shown in FIG. 2, about the supporting shafts 14 by fitting the corresponding supporting shafts 14 into the bearing portions 73 of the both arm portions 72. Further, the arm portion 72 is provided with a cam groove 74. When the lever 70 is at the initial position, entrances of the cam grooves 74 are open forward. By lightly connecting the first and second housings 10, 50, the cam followers 53 enter the entrances of the cam grooves 74 as shown in FIG. 2. When the lever 70 is rotated from the initial position toward the connection position, the cam followers 53 slide along groove surfaces of the cam grooves 74 and a cam action is exhibited between the lever 70 and the second housing 50, whereby the first and second housings 10, 50 are connected with a low connection force. When the lever 70 reaches the connection position, the cam followers 53 are located on back end sides of the cam grooves 74 and the first and second housings 10, 50 are held in a properly connected state as shown in FIG. 1.

As shown in FIGS. 1 and 2, a step portion 15 is provided over an entire circumference of an outer peripheral surface of the housing main body 11. A seal ring 90 is fitted to the outer peripheral surface of the housing main body 11 before the step portion 15. As shown in FIG. 1, when the first and second housings 10, 50 are properly connected, the seal ring 90 is resiliently sandwiched between the outer peripheral surface of the housing main body 11 and an inner peripheral surface of the receptacle 51, thereby holding a clearance between the first and second housings 10, 50 in a liquid-tight manner.

As shown in FIGS. 1 and 2, a plurality of cavities 16, into which female terminal fittings 40 are insertable, are provided and penetrate the housing main body in the front-back direction. The plurality of cavities 16 are arranged side by side in the width direction and the vertical direction at positions corresponding to the mounting holes 52. A deflectable locking lance 17 projects forward on a lower surface of each cavity 16. As shown in FIG. 2, the locking lances 17 function to resiliently lock the female terminal fittings 40 properly inserted into each of the plurality of cavities 16 and retain the female terminal fittings 40 therein.

As shown in FIGS. 1 and 2, each of the female terminal fittings 40 is long and narrow in the front-back direction and includes a tubular terminal main body 41 and a barrel portion 42 in the form of an open barrel connected behind the terminal main body 41. As shown in FIG. 1, a tip part of the mating male terminal fitting 60 is inserted into the terminal main body 41 when the first and second housings 10, 50 are connected, thereby electrically connecting the female terminal fittings 40 and the male terminal fittings 60. A locking projection 43 is provided to project downward on a lower wall of the terminal main body 41. When the female terminal fitting 40 is properly inserted into the cavity 16, the locking lance 17 is locked to the locking projection 43. The barrel portion 42 is crimped and connected to an end part of a wire 200.

Further, as shown in FIGS. 1, 2 and 6, a passage hole 18 into which the wrench preventing portion 54 can be inserted is provided to penetrate the housing main body 11 in the front-back direction at a position displaced downwardly from a vertical center of the housing main body 11. The passage hole 18 is in the form of a laterally long slit extending in the width direction. As shown in FIG. 6, the cavities 16 are dotted around an entire circumference of the passage hole 18.

Further, as shown in FIGS. 1 and 2, a retainer mounting hole 19 into which a retainer 30 is insertable is provided to penetrate the housing main body 11 in the width direction. The retainer mounting hole 19 extends vertically and is open on a lower surface of the housing main body 11. The retainer mounting hole substantially perpendicularly communicates with the respective cavities 16 and the passage hole 18. The retainer 30 properly inserted into the retainer mounting hole 19 is arranged to be able to lock the rear ends of the terminal main bodies 41 of the female terminal fittings 40 and functions to hold the female terminal fittings 40 in a state retained in the cavities 16.

As shown in FIGS. 1, 2 and 5, a rubber plug accommodation chamber 20 is provided and is open backward in a rear end part of the housing main body 11. The rubber plug 80 is inserted into the rubber plug accommodation chamber 20 from behind. The rubber plug 80 is made of rubber such as silicon rubber, in the form of a mat thin in the front-back direction and mounted in a state retained in the rubber plug accommodation chamber 20 via a rear holder 300, to be described later.

As shown in FIGS. 1, 2 and 5, a plurality of sealing holes 81 penetrate through the rubber plug 80 in the front-back direction. The plurality of the sealing holes 81 are arranged side by side in the width direction and the vertical direction at positions communicating with the respective cavities 16 in a state where the rubber plug 80 is mounted in the first housing 10. As shown in FIGS. 1 and 2, a plurality of inner peripheral lips 82 are circumferentially provided on the inner peripheral surface of each sealing hole 81 of the rubber plug 80. The wire 200 is inserted into each sealing hole 81 of the rubber plug 80 after the passage of the female terminal fitting 40 and the inner peripheral lips 82 are resiliently held in close contact with the outer peripheral surface of the wire 200 in a liquid-tight manner. Further, a plurality of outer peripheral lips 83 are circumferentially provided on the outer peripheral surface of the rubber plug 80. When the rubber plug 80 is inserted into the rubber plug accommodation chamber 20, each outer peripheral lip 83 is resiliently held in close contact with the inner peripheral surface of the rubber plug accommodation chamber 20, whereby the interior of the rubber plug accommodation chamber 20 is held in a liquid-tight manner.

Further, as shown in FIGS. 1, 2 and 5, an insertion hole 84 into which a tip part of the wrench preventing portion 54 is insertable is provided to penetrate through the rubber plug 80 in the front-back direction at a position displaced downwardly from a vertical center of the rubber plug 80. The insertion hole 84 is in the form of a laterally long slit extending in the width direction. The insertion hole 84 has a smaller vertical opening dimension than the passage hole 18. As shown in FIG. 5, the sealing holes 81 are dotted around an entire circumference of the insertion hole 84. Note that the inner peripheral surface of the insertion hole 84 extends along the front-back direction and does not include anything like the inner peripheral lips 82 unlike the sealing holes 81.

As shown in FIGS. 1 and 2, the rear holder 300 is inserted into the rubber plug accommodation chamber 20 behind the rubber plug 80. The rear holder 300 is made of synthetic resin and locked and mounted in the first housing 10 in a state in which the rear holder 300 is inserted in the rubber plug accommodation chamber 20. When the rear holder 300 is mounted into the first housing 10, the rubber plug 80 is sandwiched in the rubber plug accommodation chamber 20 in the front-back direction between the rear holder 300 and the housing main body 11.

As shown in FIGS. 1 and 2, a plurality of through holes 301 are provided to penetrate through the rear holder 300 in the front-back direction. The plurality of through holes 301 are arranged side by side in the width direction and the vertical direction at positions communicating with the respective sealing holes 81 in a state where the rear holder 300 is mounted in the first housing 10. The female terminal fitting 40 is inserted through each through hole 301 of the rear holder 300 in a substantially positioned state and, thereafter, the wire 200 is inserted in a loosely fitted state.

As shown in FIGS. 1 and 2, a wire cover 400 is mounted on the rear end part of the housing main body 11. The wire cover 400 is made of synthetic resin and is cap-shaped. The wires 200 extending from the respective through holes 301 of the rear holder 300 are inserted into the wire cover 400. The wires 200 are pulled out to an outside after being bent in the wire cover 400.

Next, functions and effects of the connector of this embodiment are described.

The rubber plug 80 and the rear holder 300 are successively inserted and mounted into the rubber plug accommodation chamber 20 of the first housing 10 from behind. When the rubber plug 80 and the rear holder 300 are mounted into the first housing 10, the plurality of cavities 16, the plurality of sealing holes 81, and the plurality of through holes 301 are arranged to coaxially communicate in the front-back direction and the passage hole 18 and the insertion hole 84 are likewise arranged to coaxially communicate in the front-back direction (see FIGS. 1 and 2). Further, the front surface of the rear holder 300 comes into substantially close contact with the rear surface of the rubber plug 80 and a rear end opening of the insertion hole 84 of the rubber plug 80 is closed by a closing surface portion 302 on the front surface of the rear holder 300 (see FIGS. 1 and 2).

Subsequently, the female terminal fittings 40 are inserted into each of the plurality of cavities 16 of the first housing 10 from behind. When the female terminal fittings 40 are properly inserted into each of the plurality of cavities 16, the wire 200 is inserted through each of the plurality of sealing holes 81 of the rubber plug 80 in a liquid-tight manner and loosely fitted and inserted through each of the plurality of through holes 301 of the rear holder 300 (see FIGS. 1 and 2). When the female terminal fittings 40 pass through each of the plurality of sealing holes 81, an edge part of the terminal main body 41 may damage the inner peripheral lips 82. However, since the plurality of sealing holes 81 are formed to have a large opening diameter, the damage of the rubber plug 80 due to interference with the female terminal fittings 40 can be avoided.

Subsequently, the first and second housings 10, 50 are lightly connected. Prior to the insertion of the male terminal fittings 60 into the terminal main bodies 41 of the female terminal fittings 40, the wrench preventing portion 54 is inserted substantially in a positioned state into the passage hole 18 of the first housing (see FIG. 2). Accordingly, even if the first housing 10 is in an inclined connection posture with respect to the second housing 50, the wrench preventing portion 54 is inserted into the passage hole 18 and the connection posture of the first housing 10 is corrected to a proper posture. Thus, a connecting operation of the first and second housings 10, 50 properly proceeds by being guided by the wrench preventing portion 54 and the male terminal fittings 60 are inserted in a proper insertion posture into the terminal main bodies 41 of the female terminal fittings 40.

When the first and second housings 10, 50 are properly connected, the tip part of the wrench preventing portion 54 is inserted into the insertion hole 84 of the rubber plug 80 and the tip of the wrench preventing portion 54 is located in the rear end opening of the insertion hole 84, and covered by the closing surface portion 302 of the rear holder 300 (see FIG. 1). Further, when the first and second housings 10, 50 are properly connected, the insertion hole 84 of the rubber plug 80 is resiliently expanded by the tip part of the wrench preventing portion 54. A compression force is applied to each sealing hole 81 arranged around the insertion hole 84 in such a direction that the inner peripheral lips 82 and the wire 200 are in close contact. Thus, the inner peripheral lips 82 of each sealing hole 81 are tightly held in close contact with the outer peripheral surface of the wire 200, thereby satisfactorily ensuring waterproofness around the wire 200. Further, as the insertion hole 84 is expanded, the compression force is also applied to the outer peripheral side of the rubber plug 80 so that the outer peripheral lips 83 and the rubber plug accommodation chamber 20 are resiliently held in close contact with the inner peripheral surface of the rubber plug accommodation chamber 20 to satisfactorily ensure also waterproofness in the rubber plug accommodation chamber 20.

As described above, according to this embodiment, the tip part of the wrench preventing portion 54 is not inserted into the insertion hole 84 of the rubber plug 80 and no compression force is applied to the sealing holes 81 in a state before the first housing 10 is connected to the second housing 50. Thus, the female terminal fittings 40 can be easily inserted into the sealing holes 81 and damage to the rubber plug 80 can be avoided.

Further, since the wrench preventing portion 54 ensures waterproofness between the inner peripheral lips 82 and the wire and the outer peripheral lips and the rubber plug accommodating chamber 20, it is not necessary to separately provide a structure for ensuring waterproofness and the overall structure can be simplified and the enlargement of the connector can be avoided.

Further, since the tip of the wrench preventing portion 54 inserted in the insertion hole 84 is covered with the closing surface portion 302 of the rear holder 300, the waterproofness of the rubber plug 80 can be ensured even though the insertion hole 84 is open on the rear surface of the rubber plug 80.

Furthermore, since a plurality of sealing holes 81 are arranged to surround the insertion hole 84 in the rubber plug 80, the compression force is substantially equally transmitted to each sealing hole 81 and waterproofness around the wire 200 inserted in each sealing hole 81 is stably ensured when the insertion hole 84 is expanded by the wrench preventing portion 54.

Other embodiments are briefly described below.

Inner peripheral lips to be resiliently held in close contact with the wrench preventing portion may be circumferentially provided on the inner peripheral surface of the insertion hole.

The insertion hole may be closed on the rear surface side of the rubber plug and open only on the front surface of the rubber plug.

The tip of the wrench preventing portion may stop at an intermediate position in the front-back direction without reaching the rear end of the insertion hole when the first and second housings are properly connected.

The tip of the wrench preventing portion may reach a position behind the housing main body beyond the rear end of the insertion hole when the first and second housings are properly connected. In this case, the rear holder may be provided with an escaping structure such as a recess for allowing the tip part of the wrench preventing portion to escape.

The present invention is also applicable to a connector of a so-called wire-to-wire type in which wires are drawn out from both first and second housings by adopting such a structure that male terminal fittings are connected to ends of the wires.

LIST OF REFERENCE SIGNS

10 . . . first housing
16 . . . cavity
18 . . . passage hole
40 . . . female terminal fitting (terminal fitting)
50 . . . second housing
54 . . . wrench preventing portion
80 . . . rubber plug
84 . . . insertion hole
200 . . . wire
300 . . . rear holder

What is claimed is:

1. A connector, comprising:

a first housing including a plurality of cavities into which terminal fittings connected to ends of wires are insertable and a passage hole penetrating in a front-back direction;

a rubber plug to be mounted in the first housing and including a plurality of sealing holes, through which the wires are insertable in a liquid-tight manner after the passage of the terminal fittings, at positions communicating with the plurality of cavities; and a second housing to be connected to the first housing and including a wrench preventing portion configured to regulate a connecting posture of the second housing to the first housing by being inserted into the passage hole at the time of the connection, wherein the rubber plug includes an insertion hole, which is expanded by the insertion of a tip part of the wrench preventing portion inserted through the passage hole at the time of the connection and applies a compression force to the sealing holes in a direction to be in closer contact with the wires when being expanded, at a position communicating with the passage hole.

2. The connector of claim 1, further comprising a rear holder to be mounted into the first housing and capable of holding the rubber plug while sandwiching the rubber plug between the first housing and the rear holder in the front-back direction, wherein the tip of the wrench preventing portion is covered with a wall surface of the rear holder at the time of the connection.

3. The connector of claim 1, wherein the plurality of sealing holes are arranged to surround the insertion hole in the rubber plug.

4. The connector of claim 1, wherein the first housing includes a rubber plug accommodating chamber and the rubber plug is accommodated in the rubber plug accommodating chamber.

5. The connector of claim 4, wherein a plurality of inner peripheral lips circumferentially provided on the sealing hole of the rubber plug and a plurality of outer peripheral lips are circumferentially provided on an outer peripheral surface of the rubber plug.

6. The connector of claim 5, wherein the compression force compresses the plurality of inner peripheral lips into close contact with the wires and the outer peripheral lips into close contact with an inner peripheral surface of the rubber plug accommodating chamber.

7. The connector of claim 1, wherein the insertion hole is a laterally long slit extending in a width direction of the rubber plug.

8. The connector of claim 1, wherein the second housing includes a tubular receptacle, and the wrench preventing portion projects forward from the receptacle.

9. The connector of claim 1, further comprising a seal ring fitted to an outer peripheral surface of the first housing, wherein the seal ring is resiliently sandwiched between the outer peripheral surface of the first housing and an inner peripheral surface of the second housing.

* * * * *